US009532144B2

(12) United States Patent
Andrews et al.

(10) Patent No.: US 9,532,144 B2
(45) Date of Patent: Dec. 27, 2016

(54) LOUDSPEAKER

(71) Applicant: Funktion One Research, Dorking, Surrey (GB)

(72) Inventors: Anthony John Andrews, Dorking (GB); John Newsham, Dorking (GB)

(73) Assignee: FUNKTION ONE RESEARCH, Surryey (GB)

( * ) Notice: Subject to any disclaimer, the term of this patent is extended or adjusted under 35 U.S.C. 154(b) by 0 days.

(21) Appl. No.: 14/694,688

(22) Filed: Apr. 23, 2015

(65) Prior Publication Data

US 2015/0312680 A1 Oct. 29, 2015

(30) Foreign Application Priority Data

Apr. 24, 2014 (GB) ..... 1407263.1

(51) Int. Cl.

| | |
|---|---|
| ***H04R 1/00*** | (2006.01) |
| ***H04R 7/26*** | (2006.01) |
| ***H04R 7/20*** | (2006.01) |
| *H04R 7/00* | (2006.01) |

(52) U.S. Cl.

CPC *H04R 7/26* (2013.01); *H04R 1/00* (2013.01); *H04R 7/20* (2013.01); *H04R 2307/201* (2013.01)

(58) Field of Classification Search

CPC ..... H04R 7/26; H04R 7/16; H04R 1/28; H04R 1/30

USPC ..... 381/413, 338, 340, 396, 398, 412, 432, 381/433; 181/166, 171

See application file for complete search history.

(56) References Cited

U.S. PATENT DOCUMENTS

| | | | | |
|---|---|---|---|---|
| 2,856,467 A | 10/1958 | Hoodwin | | |
| 3,837,425 A * | 9/1974 | Bozak | H04R 7/26 | 181/166 |
| 4,319,098 A * | 3/1982 | Baitcher | H04R 7/20 | 181/166 |
| 5,737,435 A * | 4/1998 | De Poortere | H04R 1/30 | 181/151 |
| 8,066,095 B1 * | 11/2011 | Bromer | H04R 1/2842 | 181/148 |
| 2002/0114484 A1 * | 8/2002 | Crisco | H04R 1/2842 | 381/345 |
| 2011/0044490 A1 * | 2/2011 | Makino | H04R 7/20 | 381/398 |

FOREIGN PATENT DOCUMENTS

| | | |
|---|---|---|
| GB | 937838 A | 9/1963 |
| GB | 1380914 A | 1/1975 |

OTHER PUBLICATIONS

European Search Report for European Patent Application No. EP 15162134.9, dated Sep. 7, 2015, 4 Pages.

United Kingdom Search Report, GB Application No. 1407263.1, Sep. 29, 2014, 4 pages.

* cited by examiner

*Primary Examiner* — Sunita Joshi

(74) *Attorney, Agent, or Firm* — Fenwick & West LLP

(57) ABSTRACT

A loudspeaker (100) comprising: an electro-magnetic motor (114) configured to receive electrical signals and, based on the received electrical signals to induce vibrations in a diaphragm (116) for generating a pressure wave; a surround (118) connected to the diaphragm for suspending the diaphragm from a driver chassis (120); and a damper (126) in contact with the surround for damping the vibrations in the surround and the diaphragm.

13 Claims, 2 Drawing Sheets

LOUDSPEAKER

CROSS-REFERENCE TO RELATED APPLICATIONS

This application claims foreign priority to United Kingdom Application number 1407263.1 filed Apr. 24, 2014, which is hereby incorporated by reference in its entirety.

TECHNICAL FIELD

The invention relates to loudspeakers. More specifically, the invention relates to dampening of vibrations in a diaphragm of a loudspeaker.

BACKGROUND

Loudspeakers typically comprise an electro-magnetic motor and a diaphragm or cone. The audio driver comprises a voice coil and former that are configured to move in response to electrical signals received at the audio driver. The cone is attached to the voice coil and vibrates with movement of the voice coil to cause a pressure wave, which is heard as sound by a listener.

In order to reproduce sound accurately based on the received electrical signals, a cone should ideally have pure pistonic motion. Pistonic motion may be characterised by linear motion of the cone away from and towards a plane of the electro-magnet motor with zero or minimal deformation of the cone, either due to mechanical break up or standing wave patterns.

In addition, the cone should be permitted to move freely in response to movement of the voice coil and former. Damping compound may be added to the cone but this increases the mass of the cone, which restricts the free movement of the cone and therefore distorts and/or degrades the sound produced by the loudspeaker.

SUMMARY

According to an aspect of the invention there is provided a loudspeaker comprising: an electro-magnetic motor configured to receive electrical signals and, based on the received electrical signals to induce vibrations in a diaphragm for generating a pressure wave; a surround connected to the diaphragm for suspending the diaphragm from a driver chassis; and a damper in contact with the surround for damping the vibrations in the surround and the diaphragm.

Optionally, the diaphragm is a cone.

Optionally, the cone comprises a cone input opening connected to the audio driver and a cone output opening connected to the surround.

Optionally, a surface of the surround is one of corrugated, a half roll or a double half roll.

Optionally, the loudspeaker further comprises a waveguide attached to the driver chassis.

Optionally, the waveguide comprises a waveguide input opening of substantially the same diameter as the cone output opening.

Optionally, the waveguide comprises a flange configured for attachment to the driver chassis such that the flange extends at least partially over the surround.

Optionally, the damper is positioned between the flange and the surround.

Optionally, the thickness of the damper is greater than the maximum thickness of the gap between the flange and the surround.

Optionally, the driver chassis further comprises a lip extending radially inwards and at least partially covering the surround to define a gap therebetween.

Optionally, the damper is positioned in the gap defined between the lip and the surround.

Optionally, the thickness of the damper is greater than the maximum width of the gap between the lip and the surround.

Optionally, the damper comprises an annular element configured to at least partially cover the surround.

Optionally, the damper comprises one or more of foam and rubber.

Optionally, the diaphragm comprises a material comprising one or more of paper, paper composites, paper laminates, aluminium, titanium, beryllium, glass, para-aramid, carbon composites and plastics materials.

Optionally, the surround comprises material comprising one or more of paper, cloth, rubber, foam and plastics materials.

BRIEF DESCRIPTION OF DRAWINGS

Exemplary embodiments of the invention are described herein with reference to the accompanying drawings, in which.

DESCRIPTION

Generally, disclosed herein are loudspeakers in which vibration of the diaphragm has been damped by a damper element. The damper may be in contact with a surround or suspension, which is directly connected to an outer edge of the cone.

Figure 1:
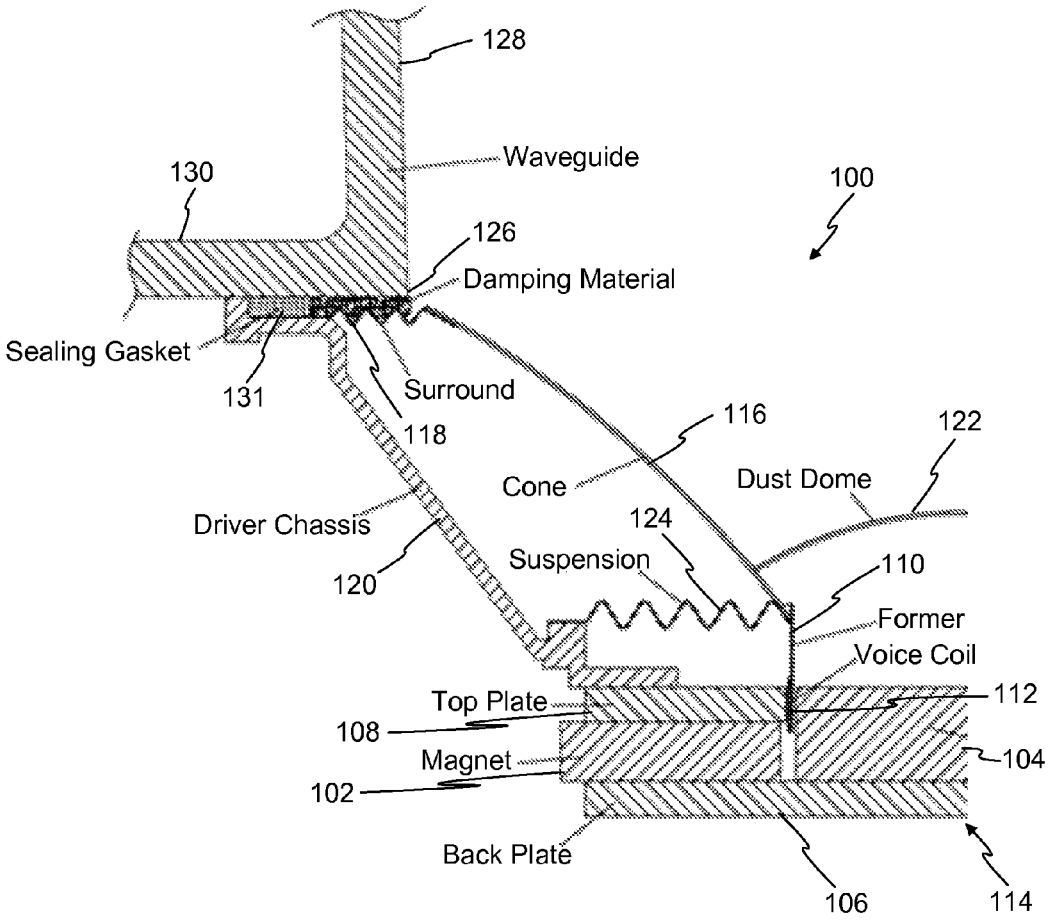
FIG. 1 is a partial section through a loudspeaker.

FIG. 1 shows a section through a loudspeaker 100. The loudspeaker 100 comprises at least one magnet 102 and a pole piece 104, which are positioned on a back plate 106. The magnet 102 is positioned between the back plate 106 and a top plate 108. The magnet 102 and top plate are annular and surround the pole piece 104. The loudspeaker 100 further comprises a former 110 and voice coil 112. Together, the magnet 102, pole piece 104, back plate 106, top plate 108, former 110 and voice coil 112 form an electro-magnetic motor 114. The electro-magnetic motor 114 is configured to receive electrical signals and induce movement in the voice coil 112 and former 110 based on the received electrical signals.

The loudspeaker 100 further comprises a diaphragm, which in the exemplary loudspeaker 100 is a cone 116 and a surround 118. The cone 116 is substantially frustum shaped and has a cone input opening at a smaller diameter end and a cone output opening at a larger diameter end. The cone 116 (and any other type of diaphragm used in other exemplary loudspeakers) may be manufactured from paper, paper composites, paper laminates, aluminium, titanium, beryllium, glass, para-aramid, carbon composites or plastics materials. The cone input opening is attached to the former 110 of the electro-magnetic motor 114.

The surround 118 is substantially annular having an inner edge and an outer edge. The inner edge is attached to the cone 116 at the cone output opening. Typically, this attachment is provided by adhesive or bonding agent. The surround 118 is attached at the outer edge to a driver chassis 120 connected to the electro-magnetic motor 114 and configured to support various elements of the loudspeaker 100. Specifically, the driver chassis 120 is substantially frustum shaped and is connected at a smaller diameter end to the top plate 108 and at a larger diameter end to the surround 118.

The surround 118 may be manufactured from paper, cloth, rubber, foam or plastics materials. A surface of the surround 118 may be corrugated to allow freedom of movement in the vertical plane and to provide stiffness in a horizontal direction and going through the page with respect to the image in FIG. 1, that is, in a direction parallel to the plane of the electro-magnetic motor 114 and circumferential with respect to the surround 118.

Relative terms such as upper, lower, vertical, horizontal etc. are used herein to aid description and need not limit the scope of the invention.

A dust dome 122 is attached to an internal surface of the cone 116 and covers the centre of the electro-magnetic motor 114, specifically the pole piece 104 the former 110 and the voice coil 112 to prevent dust ingress to the electro-magnetic motor 114. In addition, a suspension 124 (spider) is connected to the driver chassis 120 and to the cone opening end of the cone 116 to support the cone 116 at the point where it is attached to the former 110.

A damper 126 is in contact with the surround 118 and is configured to damp the vibrations of the surround 118 and the cone 116. As the surround 118 is attached to the cone 116, the damper 126 therefore damps the vibration of the cone 116 and the surround 118. This results in damped oscillations of the cone 116 during operation of the loudspeaker 100. As such, the deformation of the cone 116, either due to mechanical break up or standing wave patterns is reduced.

The damper 126 may be configured to critically damp the oscillations of the cone 116. In exemplary loudspeakers, the damper 126 may comprise foam. In exemplary loudspeakers, the damper 126 may comprise rubber.

The loudspeaker 100 further comprises a waveguide 128 having a waveguide input opening and a waveguide output opening. The waveguide input opening is configured to cooperate with the cone output opening to guide the audio waves emitted from the cone 116. The waveguide input opening is substantially circular and may have a diameter substantially equal to the cone output opening, which is the opening of the cone that has the largest diameter or "body diameter". The waveguide 128 comprises a flange 130 at the waveguide input opening. The flange 130 extends radially outwards. The flange 130 is configured for attachment to the driver chassis 120 such that the flange 130 extends at least partially over the surround 118.

The damper 126 may be positioned, at least partially, between the flange 130 and the surround 118. The damper 126 may have a thickness greater than the maximum gap between the flange 130 and the surround 118 such that the damper 126 is under compression. The damper may be annular and may cover a portion of the surround around its entire circumference. This allows the surround to vibrate but mitigates or removes any non-uniform vibration of the surround.

A sealing gasket 131 may also be adhered to the surround 118 and the driver chassis 120 in a gap between the driver chassis 120 and the flange 130.

In exemplary loudspeakers, when the waveguide 128 is fixed to the driver chassis 120, the flange 130 may not be parallel with a centre line running through the corrugations of the surround 118. This is not shown in FIG. 1 but may be the case in exemplary loudspeakers. Specifically, the flange 130 and the surround 118 may converge as they extend radially outwards such that a gap between the surround 118 and the flange 130 is greater at the waveguide input opening than at the point where the surround 118 is attached to the driver chassis 120.

In exemplary loudspeakers, the driver chassis 120 may have a lip that extends radially inwardly towards the centre of the loudspeaker 100 and defines a cavity within which the surround 118 is attached to the driver chassis 120. Therefore, the lip extends at least partially over the surround 118. The sealing gasket and/or the damper may be positioned in the cavity formed by the lip. Such exemplary loudspeakers there may have no waveguide connected to the driver chassis 120.

FIG. 1 shows an exemplary loudspeaker 100. However, it will be understood that the principles of the invention may be applied to any design of loudspeaker having a cone and a surround to which damping may be applied.

Figure 2:
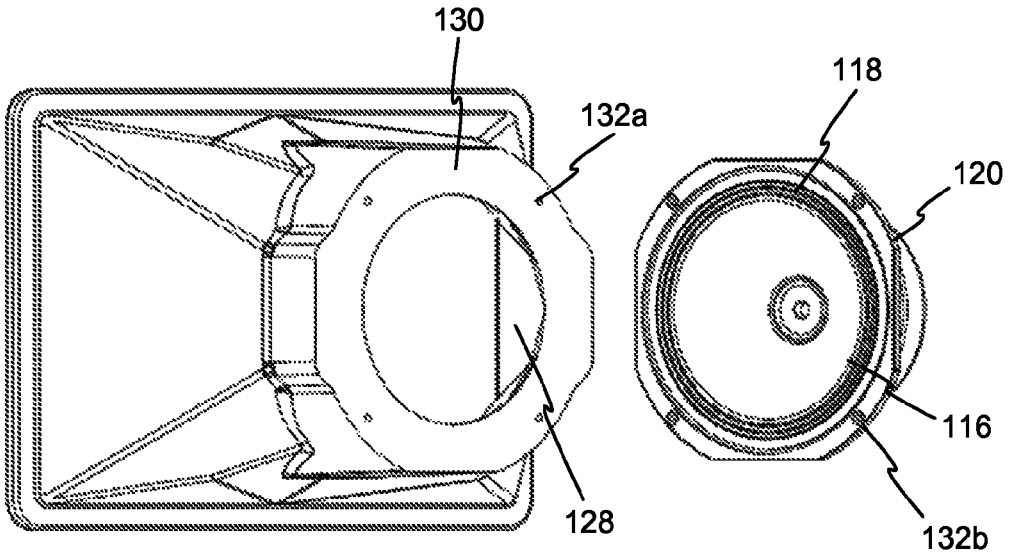
FIG. 2 is an image of a cone and surround and a waveguide.

FIG. 2 shows a waveguide 128 and a corresponding cone 116, surround 118 and driver chassis 120. The corrugations in the surround 118 can be seen in FIG. 2. The flange 130 of the waveguide 128 may be placed over the driver chassis 120 and surround 118 and secured by bolts through holes 132*a* and 132*b*.

Figure 3:
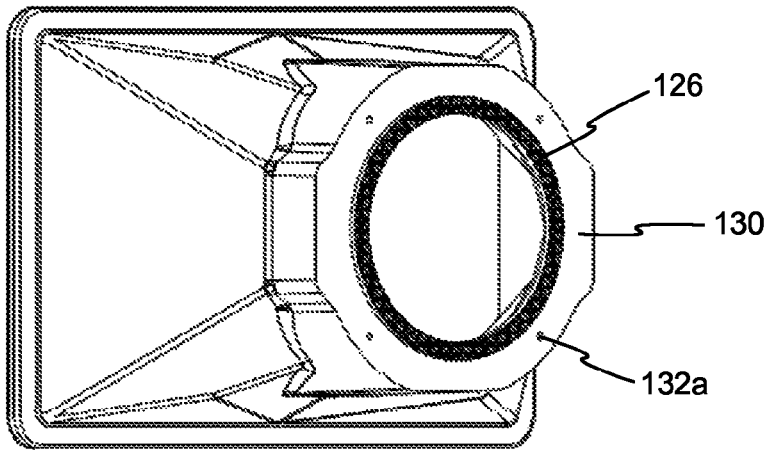
FIG. 3 is an image of a waveguide with a damper attached thereto.

FIG. 3 shows a damper 126 secured to the flange 130 of the waveguide 128. To construct the loudspeaker 100, the damper 126 may be attached to the flange 130 and the flange 130 may then be bolted to the driver chassis 120 compressing the damper in between the flange and the surround.

The invention may also be applied to other types of loudspeaker such as a compression driver, in which the diaphragm may be dome shaped and may have a single annular suspension or surround.

The skilled person will be able to envisage other embodiments of the invention without departing from the scope of the appended claims.

The invention claimed is:

1. A loudspeaker comprising:

an electro-magnetic motor configured to receive electrical signals and, based on the received electrical signals to induce vibrations in a diaphragm for generating a pressure wave;

a surround connected to the diaphragm for suspending the diaphragm from a driver chassis, the driver chassis comprising a lip extending radially inwards and at least partially covering the surround to define a gap therebetween; and a damper in contact with the surround for damping the vibrations in the surround and the diaphragm;

wherein the damper is positioned in the gap defined between the lip and the surround and the thickness of the damper is greater than the maximum width of the gap between the lip and the surround.

2. The loudspeaker according to claim 1, wherein the diaphragm is a cone.

3. The loudspeaker according to claim 2, wherein the cone comprises a cone input opening connected to an audio driver and a cone output opening connected to the surround.

4. The loudspeaker according to claim 1, wherein a surface of the surround is one of corrugated, a half roll or a double half roll.

5. The loudspeaker according claim 1, further comprising a waveguide attached to the driver chassis.

6. The loudspeaker according to claim 5, wherein the waveguide comprises a waveguide input opening of substantially the same diameter as the cone output opening.

7. The loudspeaker according to claim 5, wherein the waveguide comprises a flange configured for attachment to the driver chassis such that the flange extends at least partially over the surround.

8. The loudspeaker according to claim 7, wherein the damper is positioned between the flange and the surround.

9. The loudspeaker according to claim 8, wherein the thickness of the damper is greater than the maximum thickness of the gap between the flange and the surround.

10. The loudspeaker according to claim 1, wherein the damper comprises an annular element configured to at least partially cover the surround.

11. The loudspeaker according to claim 1, wherein the damper comprises one or more of foam and rubber.

12. The loudspeaker according to claim 1, wherein the diaphragm comprises a material comprising one or more of paper, paper composites, paper laminates, aluminium, titanium, beryllium, glass, para-aramid, carbon composites and plastics materials.

13. The loudspeaker according to claim 1, wherein the surround comprises material comprising one or more of paper, cloth, rubber, foam and plastics materials.

* * * * *